United States Patent [19]

Condolios

[11] 3,972,137

[45] Aug. 3, 1976

[54] DREDGING INSTALLATION

[75] Inventor: Elie Condolios, Grenoble, France

[73] Assignee: Societe Generale de Constructions Electriques et Mecaniques (ALSTHOM), Paris, France

[22] Filed: Apr. 1, 1975

[21] Appl. No.: 564,152

[30] Foreign Application Priority Data

Apr. 24, 1974 France ..... 74.14298

[52] U.S. Cl. ..... 37/56; 37/58

[51] Int. Cl.[2] ..... G09B 25/00

[58] Field of Search ..... 114/26–38, 114/5 R; 37/54–59, 61–63, 75, 78

[56] References Cited

UNITED STATES PATENTS

| | | | |
|---|---|---|---|
| 2,763,940 | 9/1956 | Madgwick, Sr. | 37/58 |
| 2,961,782 | 11/1960 | Bos | 37/61 |
| 3,693,272 | 9/1972 | Gariel | 37/63 |

*Primary Examiner*—Duane A. Reger
*Assistant Examiner*—Jesus D. Sotelo
*Attorney, Agent, or Firm*—Haseltine, Lake & Waters

[57] ABSTRACT

Dredging installation consisting of a fixed tower set on the sea bed and comprising silos for storing and decanting the dredged materials, with a mobile dredging pipe which can be moved on the sea bed from the silos to the dredging site and a lift pipe going from the silos to the loading ships.

5 Claims, 2 Drawing Figures

DREDGING INSTALLATION

During the dredging at sea of marine sediments at medium depths, more particularly of sand, there arise difficulties with conventional dredging means.

Indeed, conventional dredgers of the hydraulic suction type fitted with a collecting device operating as a stationary or trailed type unit dredge at depths which hardly ever exceed 20 meters.

For marine deposits at greater depths than these, it is necessary to provide different dredging arrangements.

The present invention has as its object an installation enabling the dredging of marine sand at depths between 40 and 80 meters covering very large surfaces, of the order of several square kilometers and situated on hard beds, this sand being loaded onto ships which transport the material to the unloading port.

The installation according to the invention is characterized in that it consists of a fixed tower over which a platform emerging above the water is installed, said tower being set on the sea bed to be worked and comprising at least a silo for storing and decanting the dredged materials, a mobile dredging pipe which can be moved on the sea bed from the silo to the dredging site and fitted at its end with a collecting device, a lift pump discharging, by means of a lift pipe leading to the loading ship, the materials decanted in the silo, the water and the fine materials of the mixture brought into the silo flowing, from its top part, into a well at a pressure at most equal to atmospheric pressure, by means of an overflow pipe going down into the bottom of the said well, a dredging pump discharging that water and those fine materials to bring them, by means of a discharge pipe, onto the sea bed towards a depositing site, the operation of that dredging pump constantly being regulated so as to maintain, in the said well, a level such that the difference in pressure between that level and that of the surface causes automatically a flow at a determined rate in the said dredging pipe.

The rotation speed of the dredging pump could be regulated by a flow detector on the overflow pipe, to obtain, in that pipe, a predetermined discharge corresponding to the dredging flow which is required to be obtained in the dredging pipe and the level is then established in the well at the necessary height for maintaining that flow in the dredging pipe despite the variations in loss of head which could occur.

The fixed tower is set and ballasted on the hard sea bed, near the deposit to be worked. Above the storage silos, several feet bear the upper platform situated clearly above the level of the sea. All the elements necessary for working the installation are situated on the platform.

The sand conveying pipe extends from the deposit to the silo of the tower. It is mobile and bears ballasts and floats for the moving thereof during the working of the deposit. A suction collecting device is connected to the end of that conveying pipe. The suction collecting device is fixed by cables to a surface buoy fixed by cables to the sea bed. The progessive digging of the collecting device into the deposit enables deep dredging. The movement of the buoy on its fixing cables enables dredging over the whole surface of the deposit. The movements of the buoy and of the collecting device are remote-controlled by radio from the platform of the fixed tower by the operating personnel there.

The dredged materials are decanted into the storage silos of the fixed tower and are conveyed again by pumping and discharged by the lift pipe towards a loading buoy to which ore ships moor.

That buoy is fixed by a cable to the sea bed.

The dredging water and the fine materials which it contains, are brought into the well by means of an overflow pipe fitted with a valve going down into the bottom of the well. The dredging water and its fine materials are taken up in the well by the dredging pump and discharged by means of a discharge pipe to the depositing site for the fine materials to be removed.

The hydraulic starting up of the installation is as follows:

Firstly, the collecting device is supported by means of the cables connecting it to its support buoy, just above the deposit and the valve of the overflow pipe is closed.

The dredging pump is started up, this causing the lowering of the water level in the well.

In these conditions, if the cock of the overflow pipe is opened, a flow of water is set up from the collecting device by the dredging pipe, the silo and the overflow pipe and is brought into the well.

The dredging operation is then started up by sinking the collecting device into the deposit.

The speed of the flow near the collecting device draws the materials into the dredging pipe to convey them to the silos.

As the collecting device sinks in the deposit, the materials cave in and it is necessary only to regulate the speed of descent of the collecting device as a function of the discharge flowing into the well to maintain the stability of the hydraulic conveying.

The materials and the sea water arriving through the dredging pipe are brought into the silo where the materials are deposited.

The sea water draws along the fine materials, for example those which are smaller than 0.1 mm, through the flow pipe of the silo.

The dredging pump then removes the water and the fine materials through the discharge pipe to the deposit site for fine materials.

A flow detector on the overflow pipe makes it possible to regulate the rotation speed of the dredging pump to obtain, in that pipe, a predetermined flow rate corresponding to the dredging rate and the level is then established in the well at the height necessary for maintaining that flow rate in the dredging pipe despite the variations in loss of head which could occur during dredging.

The discharge detector also makes it possible, taking into account the level in the well, to regulate the position of the collecting device for depth.

Hereinafter, by way of an example, an embodiment of a dredging installation is described with reference to the accompanying drawings, wherein.

Figure 1:
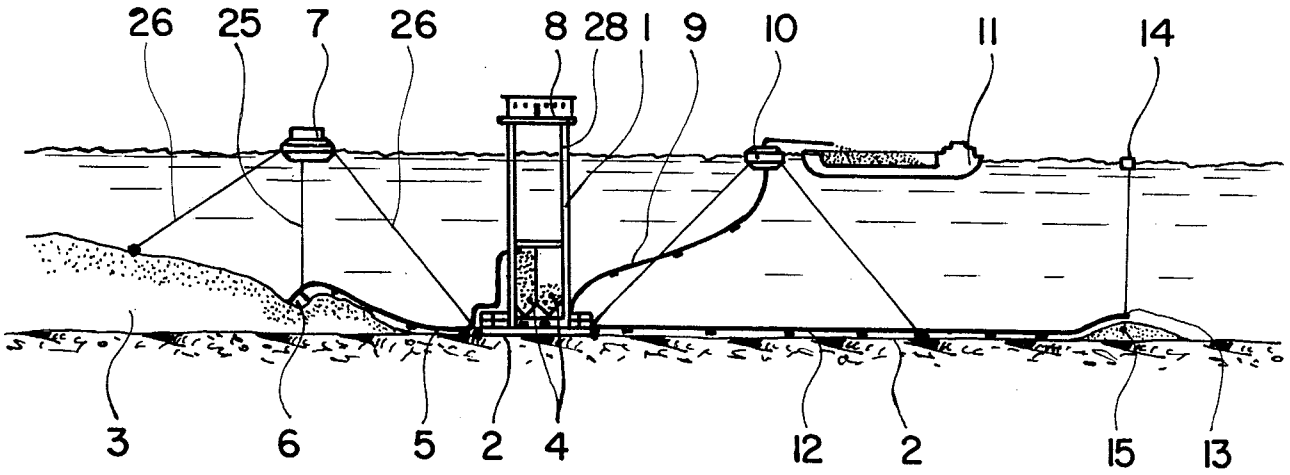
FIG. 1 is a general diagrammatic view of the installation.

FIG. 1 is a diagrammatic general view of a dredging installation according to the invention comprising a tower 1, set and ballasted on the sea bed 2 close to the deposit 3 to be worked by dredging, said tower containing storage and decanting silos 4 for the dredged materials conveyed by means of a movable flexible pipe 5 having a collecting device 6 at its free end, the latter being held in position by a buoy 7 moved by remote-control from a control platform 8 placed above the level of the sea and connected to the tower by columns 28.

The collecting device 6 can thus sweep the whole surface of the deposit 3. A discharge pipe 9 extending from the base of the silos 4 and whose end is fixed to a buoy 10 makes it possible to discharge the dredged material into a ship 11 moored to the buoy 10, a resilient pipe 12 laid on the sea bed 2 and whose end 13 is fastened to a buoy 14 makes it possible to discharge the dredging water and the fine materials which it may contain at a site 15 which can be chosen fairly far from the deposit; the dredging operations of regulating the discharge of the dredging and lift pumps, positioning of the buoys, etc., are controlled from the platform 8.

The collecting device 6 is fixed to the buoy 7 by means of a cable 25 positioning the collecting device for height; said cable controlling the lowering and raising of the collecting device 6 by means of a winch.

Cables 26 fixed to the bottom and wound on winches make it possible to position the buoy 7 at the surface.

The controlling of the winches of the buoy is effected by radio from the platform 8 of the dredging tower.

Figure 2:
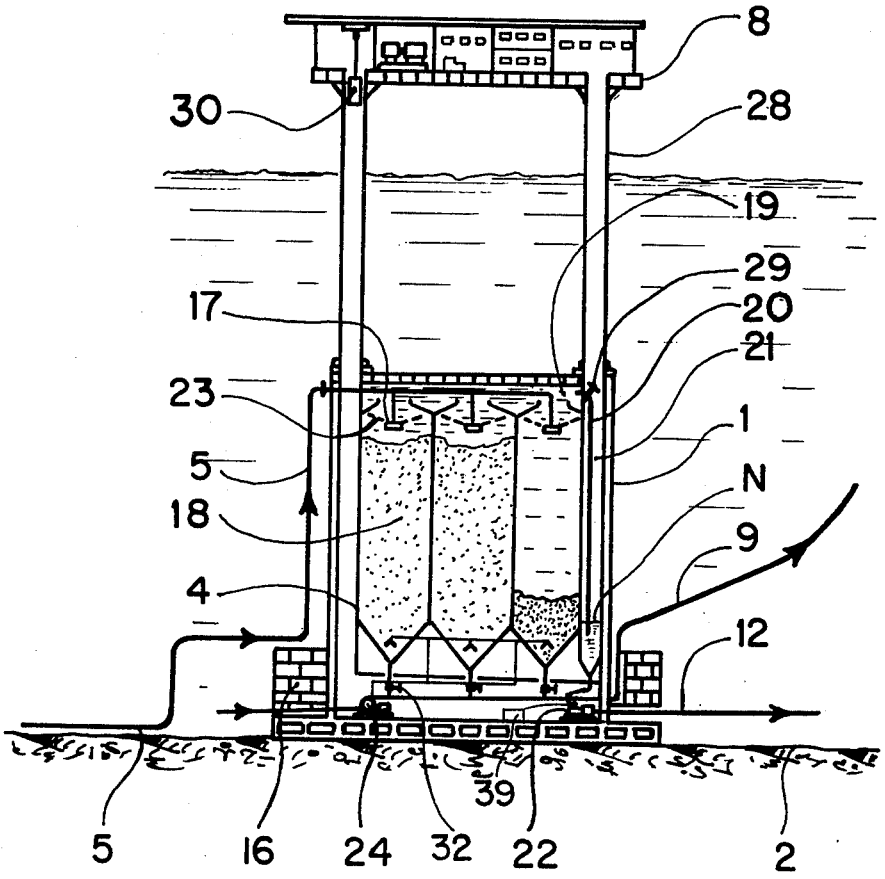
FIG. 2 is a vertical cutaway view of the dredging tower of the installation.

FIG. 2 shows the dredging tower 1 as a whole, set on the sea bed 2, connected to the top platform 8 by the columns 28 and suitably ballasted in its lower part by blocks 16.

The tower contains several storing and decanting silos 4 for the dredged materials, these materials being brought to the top part of each silo at 17 by the dredging pipe 5 and being decanted at 18 into the bottom of the silo, the water and the fine elements remaining at the top part at 19 and flowing by an overflow pipe 20 into a well 21.

The overflow pipe 20 is fitted with a valve 29 which is closed at the time of the starting up of the installation on a new dredging site. The well communicates with the atmosphere and is used as a suction tank for the dredging pump 22 which discharges the water and the fine materials through the resilient pipe 12 at the depositing site 15 shown in FIG. 1. The rotation speed of that pump is controlled by a flow indicator 39 arranged on the overflow pipe 20 in order to ensure at all times in that pipe a predetermined flow rate, corresponding to the dredging discharge rate which is required to be obtained.

In these conditions, the level N in the well is established at a depth such that the pressure above the collecting device 6 causes a flow corresponding to the dredging discharge rate required in the pipe 5 for conveying the materials towards the silos 4 despite the variations in loss of head which could occur during dredging.

Each silo 4 is provided with a distribution device 23 making it possible to accelerate and improve the decanting of sand into the silos.

The base of the silos 4 is connected by means of valves 32 to the lift pipe 9 fitted with a lift pump 24 so that on starting-up pump 24 from the platform 8 and on opening the valves 23 of the silos which are required to be emptied, the materials decanted in the silos are discharged by the pipe 9 into the transport ship 11 which is shown in FIG. 1.

The pumping well 21 is constituted by one of the columns 28, the other columns possibly acting as communication wells and containing, for example, lifts and freight elevators 30.

The upper platform 8 placed clearly above the level of the sea bears the control room for the collecting device 6 and for the dredging and discharge pumps 22 and 24, as well as the power generator unit rooms, the personnel rest rooms and the store rooms.

I claim:

1. A dredging installation for use on a bed of a body of water, said installation comprising a fixed tower mounted on the bed of the body of water and extended above the surface of the water, a platform mounted on said tower above the surface of the water, said tower comprising at least one silo for storing and decanting dredged materials, a mobile dredging pipe connected to said silo and movable on the bed to the dredging site, a collecting device connected to said mobile pipe at the free inlet end thereof, a lift pump connected to said silo, a lift pipe connected to said lift pump and extending to a loading ship for delivering to said ship dredged material from said silo, a well connected to said silo at the upper end thereof to receive at a pressure at most equal to atmospheric pressure materials decanted in the silo consisting of water and fine materials of the mixture brought into the silo, an overflow pipe extending to the bottom of said well for conveying decanted materials from sad silo into said well, a dredging pump connected to the bottom of the well for discharging the water and the fine materials therein, a discharge pipe connected to the dredging pump and having an outlet end for discharging the water and fine materials onto the bed at a deposit site removed from said tower, and regulating means for constantly regulating said dredging pump to maintain in said well a liquid level such that the difference in pressure between such level and that of the surface of the body of water automatically produces a flow at a determined rate in said dredging pipe.

2. A dredging installation as claimed in claim 1 wherein said regulating means includes a flow detector in said overflow pipe controlling said dredging pump and the position of the collecting device for depth.

3. A dredging installation as claimed in claim 1 wherein said lift pump and dredging pump are mounted at the bottom of said tower.

4. A dredging installation as claimed in claim 1 wherein said well is mounted in said tower adjacent said silo.

5. A dredging installation as claimed in claim 4 comprising valve means on said overflow pipe for controlling flow from said silo into said well.

* * * * *